US009938704B2

(12) United States Patent
deLoache, III

(10) Patent No.: US 9,938,704 B2
(45) Date of Patent: Apr. 10, 2018

(54) LIGATURE-RESISTANT TOILET SYSTEM WITH ADAPTABLE SHROUD

(71) Applicant: BEHAVIORAL SAFETY PRODUCTS, LLC, Watkinsville, GA (US)

(72) Inventor: Robert Lee deLoache, III, Watkinsville, GA (US)

(73) Assignee: BEHAVIORAL SAFETY PRODUCTS, LLC, Watkinsville, GA (US)

( * ) Notice: Subject to any disclaimer, the term of this patent is extended or adjusted under 35 U.S.C. 154(b) by 34 days.

(21) Appl. No.: 15/075,799

(22) Filed: Mar. 21, 2016

(65) Prior Publication Data

US 2017/0268213 A1 Sep. 21, 2017

(51) Int. Cl.

| | |
|---|---|
| ***E03D 11/14*** | (2006.01) |
| ***E03D 9/00*** | (2006.01) |
| ***E03D 5/10*** | (2006.01) |
| ***A47K 13/26*** | (2006.01) |
| ***E03D 5/00*** | (2006.01) |
| ***A47K 13/24*** | (2006.01) |
| ***E03D 1/012*** | (2006.01) |

(52) U.S. Cl.

CPC ..... *E03D 9/00* (2013.01); *A47K 13/242* (2013.01); *A47K 13/26* (2013.01); *E03D 1/012* (2013.01); *E03D 5/00* (2013.01); *E03D 5/105* (2013.01); *E03D 11/14* (2013.01); *E03D 11/143* (2013.01)

(58) Field of Classification Search

CPC ..... E03D 1/012; E03D 5/00; E03D 11/143; A47K 13/242

USPC ..... 4/DIG. 15

See application file for complete search history.

(56) References Cited

U.S. PATENT DOCUMENTS

| | | | | |
|---|---|---|---|---|
| 1,815,855 | A | 9/1929 | Lauritano | |
| 2,860,348 | A * | 11/1958 | McClenahan | E03C 1/01 4/425 |
| 3,495,276 | A | 2/1970 | Suess | |
| 3,573,344 | A | 4/1971 | Snyder | |
| 3,729,113 | A | 4/1973 | Lopatka | |
| 3,901,406 | A | 8/1975 | Kivett | |
| 3,924,279 | A * | 12/1975 | Morris | E03D 11/143 4/252.2 |

(Continued)

OTHER PUBLICATIONS

U.S. Appl. No. 29/555,812, filed Feb. 25, 2016, deLoache III.

*Primary Examiner* — Kevin Murphy

(74) *Attorney, Agent, or Firm* — Mitch Harris, Atty at Law, LLC; Andrew M. Harris

(57) ABSTRACT

A toilet system with a toilet base including a toilet bowl and a shroud for covering a plumbing riser located at a rear end of the toilet base that provides ligature-resistance for institutional applications. The shroud has a mating feature that joins with a corresponding feature at a rear portion of the toilet base to prevent formation of a gap between the base and a front of shroud in at least at a top side of the area of contact between the shroud and the back of the toilet base. The mating feature can be provided by forming a rectangular cross-section at the rear of the toilet base and providing a matching aperture through the shroud. A toilet seat, which may be bonded or bolted to toilet base has an outer edge that is chamfered to prevent ligature formation around a portion of toilet seat.

15 Claims, 6 Drawing Sheets

(56) References Cited

U.S. PATENT DOCUMENTS

| | | | | |
|---|---|---|---|---|
| 3,987,502 | A * | 10/1976 | Hartmann | E03C 1/01 137/392 |
| 4,558,472 | A | 12/1985 | Fromme et al. | |
| 5,251,340 | A | 10/1993 | Su-Land | |
| 5,680,949 | A | 10/1997 | Roesler | |
| 6,129,109 | A | 10/2000 | Humber | |
| 6,687,922 | B1 * | 2/2004 | Marshall | E03D 11/02 4/420 |
| 2006/0085901 | A1 | 4/2006 | Janssen | |
| 2011/0174392 | A1 | 7/2011 | deLoache, III et al. | |
| 2015/0197927 | A1 * | 7/2015 | Hall | E03D 1/012 137/382 |

* cited by examiner

LIGATURE-RESISTANT TOILET SYSTEM WITH ADAPTABLE SHROUD

BACKGROUND OF THE INVENTION

1. Field of the Invention

The present invention relates generally to a toilet system including a toilet bowl and a site-adaptable shroud for closing the space between the back of the toilet and a wall and floor behind the toilet.

2. Description of the Related Art

Ligature-resistant design is a requirement in many institutional locations. In particular, in rooms where persons may be left unattended and where there is a risk that parts of the toilet or toilet plumbing might be used as a support to tie a ligature, such as a belt, rope or a cloth, a way to ensure that the toilet or plumbing cannot be used in such a manner is desirable. In general, ligature-resistant design is an issue that extends to the floor, since ligature attachment may occur near the floor and then the ligature may extend over another object.

Further, in other installations, shrouding the back of the toilet and plumbing is desirable to prevent possible damage to or removal of the plumbing fixtures themselves or it may be desirable to shroud the plumbing fixtures so that cleaning is simplified.

Existing shrouds for covering toilet plumbing are typically fabricated from stainless steel, for durability and anti-corrosion purposes. Each shroud is typically fabricated as a custom assembly for each installation, and each location in which the shrouds are installed may require multiple designs, since the location of wall studs and other structural features typically causes variation in the exact plumbing details for each fixture. More recently, an adjustable plastic shroud has been developed as described in U.S. Published Patent Application US20110174392A1, which is assigned to the Applicant. However, ligature attachment points may still be provided between the toilet and the shroud, since a belt, strap or other article can be inserted in gaps that exist between the shroud and the toilet, the shroud and the floor and between the shroud and the wall.

Therefore, it would be desirable to provide a toilet system that can be installed in a variation of toilet plumbing configurations and that prevents ligature formation.

SUMMARY OF THE INVENTION

The above objectives, among others, are achieved in an adaptable toilet system and a method of closing the back of a toilet base to a wall and floor.

The toilet system includes a toilet base including a toilet bowl and a shroud for covering the back of the toilet base and plumbing located at a rear end of the toilet base. The shroud has a mating feature that joins with a corresponding feature at a rear portion of the toilet base to prevent formation of a gap between the toilet base and a front of the shroud in at least at a top side of the area of contact between the shroud and the back of the toilet base.

In another aspect the toilet system includes a toilet seat that has a sloped edge to prevent ligature attachment. The seat may be provided by a removable plastic seat that is bolted to or bonded to a top surface of the toilet base.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present disclosure illustrates toilet systems including a shroud and a toilet base that have at least one mating feature that prevents ligature formation at the location where the shroud and toilet base meet. The toilet system further prevents formation of ligatures under the shroud as might otherwise be possible with shroud installations that do not extend to a floor to which the toilet base is mounted or to the wall behind the toilet. Shrouds are a necessity over plumbing in facilities such as prisons and mental healthcare institutions in which the plumbing or toilet base may serve as an attachment point for a ligature that a person may use in a suicide attempt. Further, shrouds may be desirable in prisons and public facilities to prevent damage to the plumbing itself. The toilet system disclosed herein has a field-adaptable shroud that can be adjusted and/or modified to cover a plumbing riser over typical variations in building plumbing rough-in dimensions. The toilet system disclosed herein also includes a toilet seat having a sloped outer edge that prevents attachment of a ligature around all or a portion of the toilet seat. The toilet seat may be bolted to or bonded to the top of the toilet base.

Figure 1:
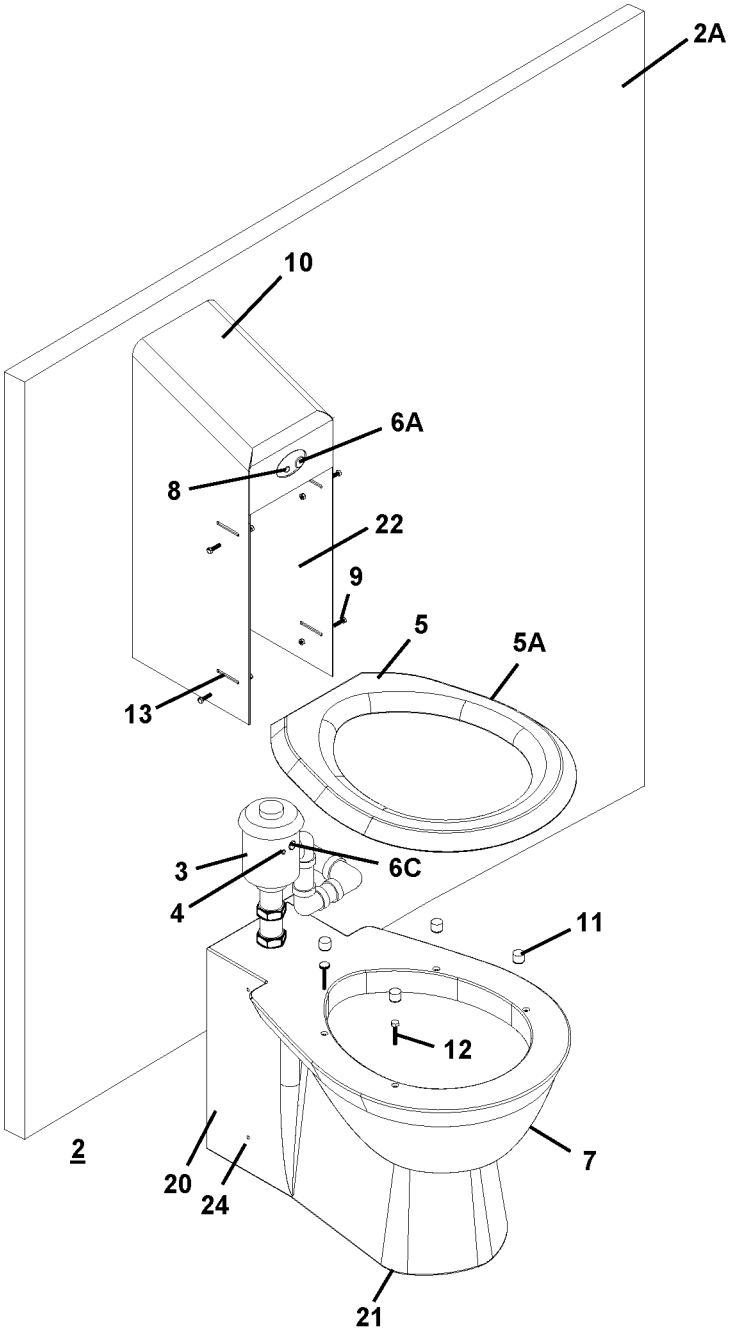
FIG. 1 is an exploded view of an example toilet system installation.

Referring now to FIG. 1, an exploded view of an example toilet system installation is shown. A flat bottom 21 of a toilet base 7 is mounted to a floor 2 in front of a wall 2A to connect an existing waste outlet to the building waste system and support toilet base 7 on floor 2. Inlet flush water is plumbed with a plumbing riser 3 that may includes an electronic flush valve with an optical sensor 4 and a manual flush button 6C, or flush button may operate a hydraulic valve, with optical sensor 4 omitted. Plumbing riser 3 generally connects to a plumbing system within wall 2A, but alternatively, the inlet water can be provided through the floor. A shroud 10 is provided to cover both plumbing riser 3 and a rear portion 20 of toilet base 7. Rear portion 20 of toilet base 7 has a rectangular vertical cross-section profile providing a mating feature that is matched in dimension to an aperture 22 having a rectangular shape that forms a corresponding mating feature formed by shroud 10, so that when shroud 10 is mounted behind toilet base 7, aperture 22 fits over toilet base 7 so that a belt or other cord-like object cannot be slid behind rear portion 20 of toilet base 7 to provide a ligature. Shroud 10 is fastened to toilet base 7 by bolts 9 or other suitable fasteners that extend into or through holes 24 in the rear portion 20 of toilet base 7. Slotted holes 13 may be provided in shroud 10, so that shroud 10 can be slid toward or away from wall 2A to ensure a snug fit between wall 2A and the back of shroud 10 which extends beyond the back end of toilet base 7, i.e., past rear portion 20 of toilet base 7 toward wall 2A. Shroud 10 is pre-fabricated from a plastic or sheet metal material that can be site-cut to fit the back edges of shroud 10 to the slope of wall 2A with respect to plumb (vertical), so that shroud 10 provides a continuous contact with wall 2A along the periphery of the back edge of shroud 10. Shroud 10 thus prevents insertion of a cord-like object between shroud 10 and wall 2A, preventing formation of a ligature at or below the top back edge of shroud 10 between shroud 10 and wall 2A. Since the sides of shroud 10 extend to floor 2, insertion of a cord-like object above the back of toilet base 7 or around plumbing riser 3 from below toilet base 7 is also prevented. The top surface of shroud 10 is sloped, preventing the use of shroud 10 itself as a point for securing a cord-like object to form a ligature.

If an optical flush valve actuator is used, shroud 10 includes facilities for providing control of the electronic flush valve of plumbing riser 3, in particular, a transparent aperture or window 8 for permitting optical sensor 4 to operate while shroud 10 is installed. In hydraulic or electrical valve installations, a manual actuator 6A that operates manual flush button 6C is provided on shroud 10. A seat 5 is securely fastened to toilet base 7 by a plurality of fasteners, so that no gap is formed between seat 5 and the top surface of toilet base 7, so that a ligature cannot be formed by inserting a cord-like object between seat and the top surface of toilet base 7. Further, seat 5 has a chamfered outer edge 5A that prevents ligature formation around any part of the outside of seat 5. In the depicted example, a plurality of bolts 12 are fastened through holes disposed around the top edges of toilet base 7 and a set of caps 11 that are attached to the tops of bolts 12 can then be secured to corresponding holes in the bottom of seat 5 by a suitable adhesive or other suitable fastening arrangement, so that seat 5 cannot be easily separated from toilet base 7 without tools to remove bolts 12. Alternatively, seat 5 can be bonded directly to toilet base 7 with an adhesive or other attachment means.

Figure 2:
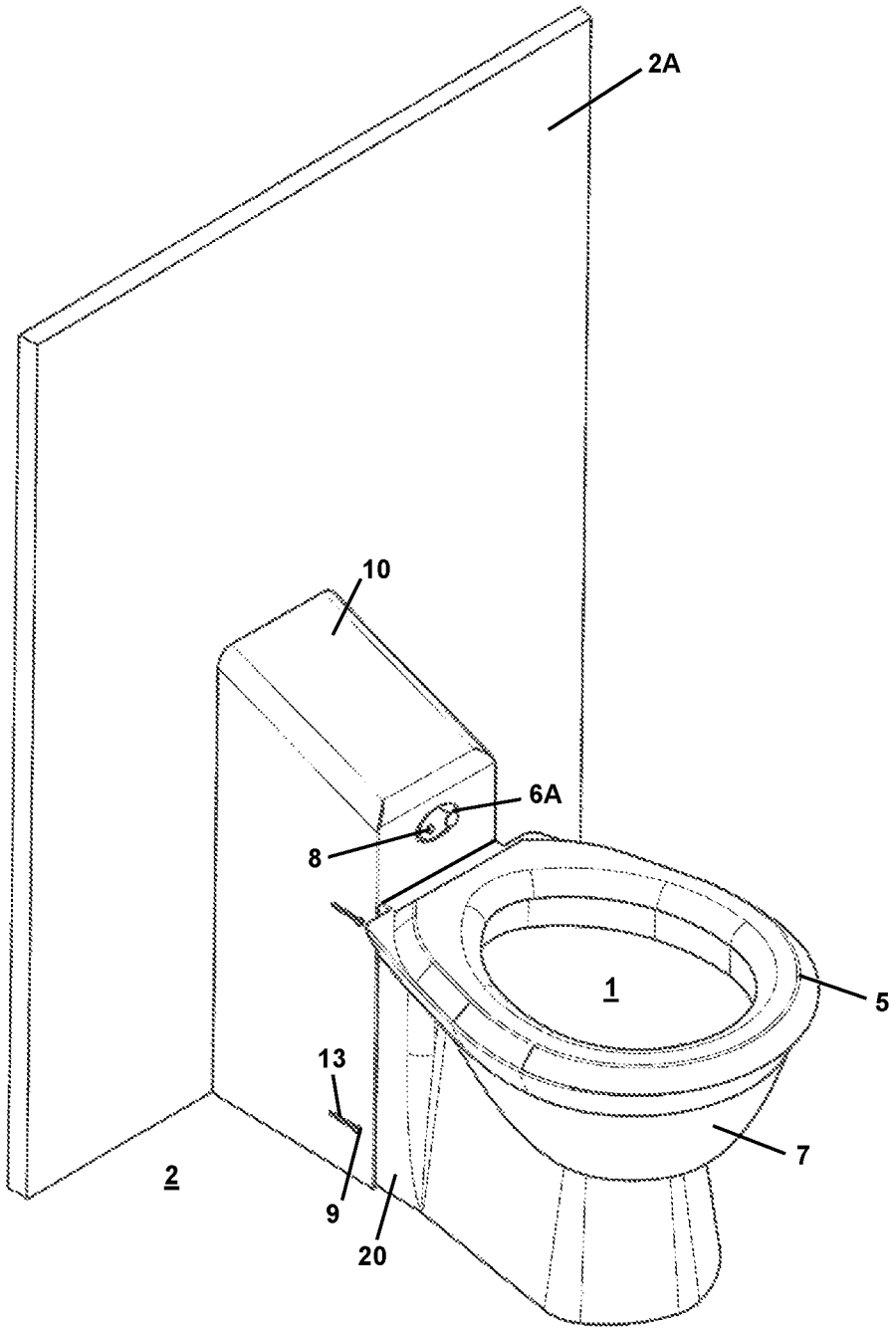
FIG. 2 is a perspective view of an example installed toilet system.

Referring now to FIG. 2, a perspective view of the example toilet system installation is shown. As shown, shroud 10 is installed against wall 2A and above the rear portion 20 of toilet base 7 behind a bowl 1 that is surrounded by seat 5, which has been secured to toilet base 7. Bolts 9 are tightened to secure shroud 10 in position against wall 2A, after shroud 10 is slid away from bowl 1 rearward along rear portion 20 of toilet base 7 to press against wall 2A. Shroud 10 may be fabricated so that the aperture 22 is exactly the same height as vertical edges of rear portion 20 of toilet base 7. Alternatively, shroud 10 may be fabricated so that the aperture 22 is initially somewhat longer than the vertical edges of rear portion 20 of toilet base 7, so that the bottom edges of shroud 10 can be trimmed to fit securely against a floor 2.

Figure 3:
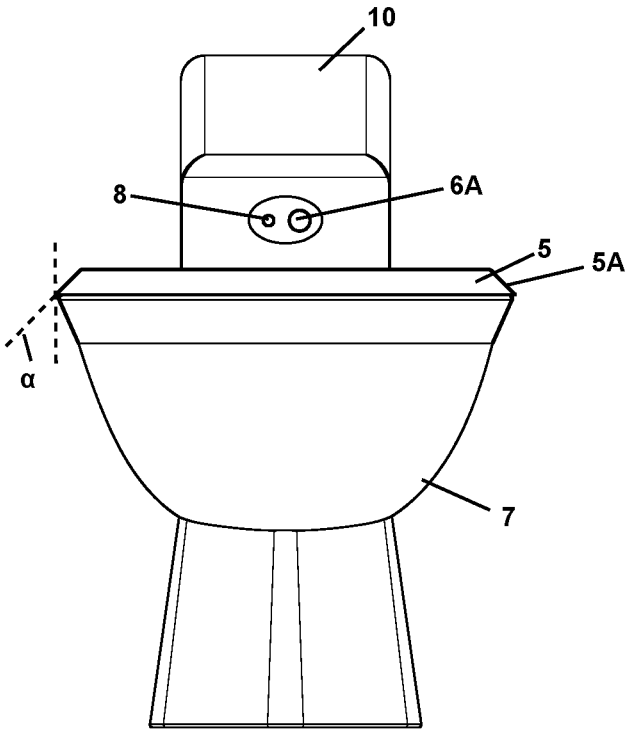
FIG. 3 is front view of the toilet system of FIG. 2.
Figure 4:
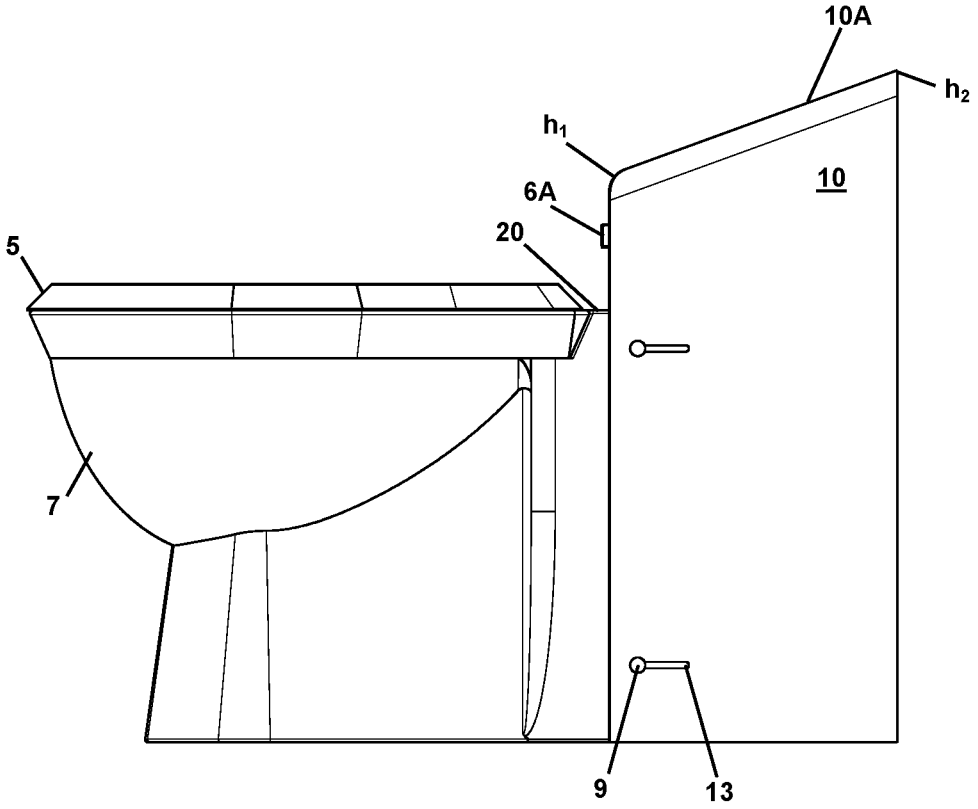
FIG. 4 is a side view of the toilet system of FIG. 2.

FIG. 3 and FIG. 4 show a front view, and a side view, respectively, of the toilet system installation shown in FIG. 2, as described above. In FIG. 3, a slope a of chamfered edge 5A of toilet seat 5 can be seen, which in the depicted example is approximately a 45 degree angle with respect to the plane of the bottom surface of toilet set 5, i.e., with respect to the horizontal top surface of toilet base 7 around toilet bowl 1. In FIG. 4 a height $h_1$ of the front edge of shroud 10 is shown in relation to the taller rear edge of shroud 10, which has a height $h_2$, so that shroud 10 slopes downward toward the front edge, so that a top surface 10A of shroud 10 does not provide a location to form a ligature.

Figure 5:
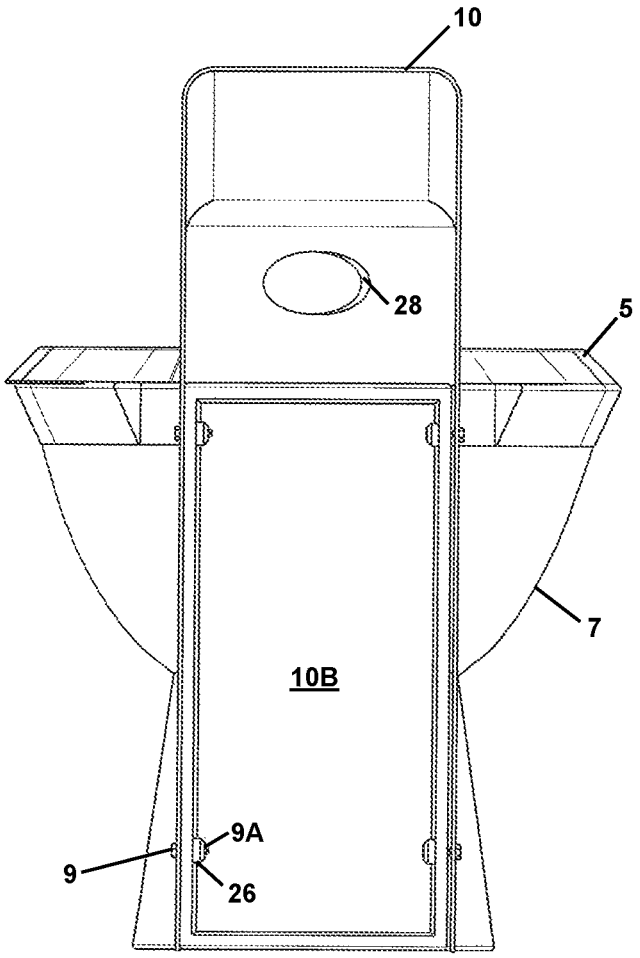
FIG. 5 is a rear view of the toilet system of FIG. 2.
Figure 6:
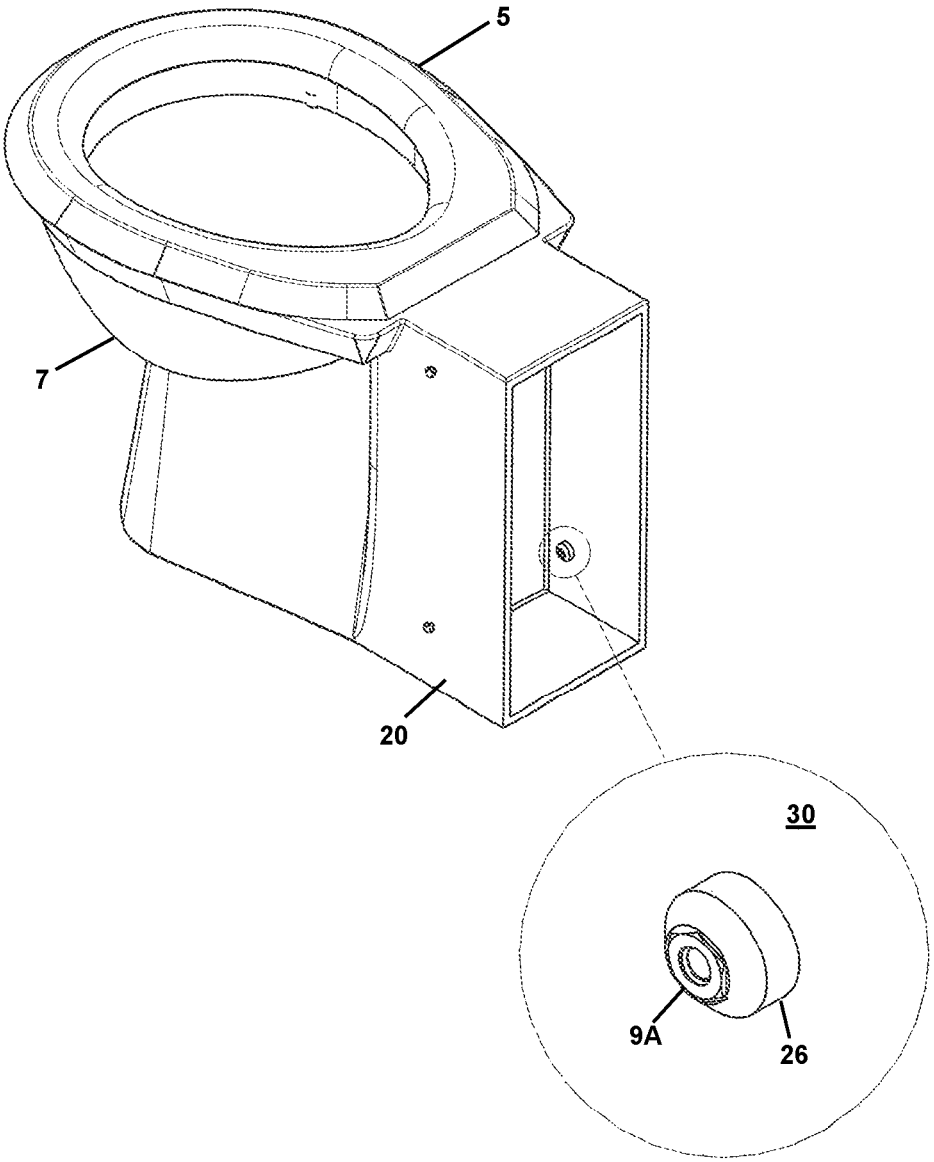
FIG. 6 is a rear perspective view of the toilet system of FIG. 2.

FIG. 5 and FIG. 6 show a rear view, and a rear perspective view, respectively, of the toilet system installed in the illustration of FIG. 2, as described above. In FIG. 5, an aperture 28 that provides mounting of transparent aperture or window 8 and/or manual actuator 6A is shown, along with bosses 26 that receive mating fasteners such as nylon nuts 9A that are inserted into friction-fit or captive recesses within bosses 26 prior to installation, so that bolts 9 can be used to attach shroud 10 to rear portion 20 of toilet base 7. FIG. 6 shows further details of bosses 26 and the securing of nylon nuts 9A in callout 30.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A toilet system that prevents attachment of a ligature, comprising:

a toilet base including a toilet bowl, the toilet base having a flat bottom for supporting the toilet base on a floor of a room and a rear portion extending backward from the toilet bowl and having a rectangular vertical cross section along at least a portion of the backward extension of the rear portion terminating at a back end of the toilet base; and a shroud for covering a plumbing riser located at a rear end of the toilet base, the shroud having a mating feature including a rectangular aperture that fits over the rear portion of the toilet base, and wherein the shroud has sides that extend to the bottom of the toilet base along both sides of the rear portion of the toilet base and backward past the back end of the toilet base to prevent formation of a gap between the rear portion of the toilet base and a front of the shroud in at least at a top side of the area of contact between the shroud and the back of the toilet base.

2. The toilet system of claim 1, wherein the shroud includes a plurality of slots through sides of the shroud for accepting a corresponding plurality of fasteners that secure the shroud to the rear of the toilet base, whereby the shroud is adjustable to locate rear edges of the shroud against a wall behind the toilet base, wherein a distance between the wall and the toilet base is determined by a position of a waste outlet of the toilet base when the toilet base is installed to the waste system of a building, and wherein the plurality of slots provide adjustment of a position of the shroud to contact the wall to compensate for variation in position of the toilet base with respect to the wall.

3. The toilet system of claim 2, wherein the shroud is made from a sheet material that can be cut at an installation site of the toilet system to match a plumb of a wall in front of which the toilet base is mounted and to match a distance between the wall and the toilet base.

4. The toilet system of claim 2, wherein the shroud has a sloped top such that a rear height of the shroud at a wall in front of which the toilet base is mounted is greater than a front height of the shroud.

5. The toilet system of claim 4, wherein the front height of the sloped top of the shroud is greater than a height of a top of the rear portion of the toilet sufficient to accommodate a height of the plumbing riser above the rear of the toilet, and wherein the shroud has a front face extending from a top of the rear of the toilet to the front of the sloped top of the shroud.

6. The toilet system of claim 1, further including a seat mounted to the toilet bowl in a fixed position such that no gap is formed between a bottom surface of the seat and a top surface of the toilet bowl, wherein the seat has a chamfered outer edge to prevent attachment of a ligature around the toilet seat.

7. A toilet system that prevents attachment of a ligature, comprising:

a toilet base including a toilet bowl, the toilet base having a flat bottom for supporting the toilet base on a floor of a room; and a shroud for covering a plumbing riser located at a rear end of the toilet base; and a toilet seat attached to a top surface of the toilet base around the toilet bowl in a fixed position, wherein the toilet seat has a chamfered outer edge and no gap is formed between the top surface of the toilet base and the toilet seat to prevent attachment of a ligature around the toilet seat, wherein the seat is permanently fastened to caps that are secured with bolts extending through a top surface of the toilet bowl, wherein the top surface of the toilet bowl includes a plurality of holes extending therethrough for receiving the bolts.

8. The toilet system of claim 7, wherein an angle of the chamfered outer edge with respect to a top horizontal face of the toilet base is substantially equal to 45 degrees.

9. The toilet system of claim 7, wherein the seat is permanently bonded to the top surface of the toilet bowl.

10. A method of providing a toilet system that prevents damage to a plumbing riser or use of the plumbing riser or toilet as a ligature securing device, the method comprising:

affixing a toilet base including a toilet bowl and a rear portion extending backward from the toilet bowl, the rear portion having a rectangular vertical cross section along at least a portion of the backward extension of the rear portion terminating at a back end of the toilet base to a floor of a room by mounting a flat bottom portion of the toilet base to the floor; and affixing a shroud above the toilet base to cover the plumbing riser, the shroud having a mating feature including a rectangular aperture that fits over the rear portion of the toilet base and has sides that extend to the bottom of the toilet base along both sides of the rear portion of the toilet base and backward past the back end of the toilet base to prevent formation of a gap between the rear portion of the toilet base and a front of the shroud in at least at a top side of the area of contact between the shroud and the back of the toilet base.

11. The method of claim 10, wherein the rear portion of the toilet base has a rectangular cross section and wherein the shroud forms a rectangular aperture sized to fit the rectangular cross section of the toilet base to provide the mating feature that the affixing fits over the rear portion of the toilet base.

12. The method of claim 11, further comprising adjusting the shroud to locate rear edges of the shroud against a wall behind the toilet base, wherein a distance between the wall and the toilet base is determined by a position of a waste outlet of the toilet base when the toilet base is installed to the waste system of a building, wherein the shroud includes a plurality of slots through sides of the shroud for accepting a corresponding plurality of fasteners that secure the shroud to the rear of the toilet base, whereby the adjusting comprises sliding the fasteners within their corresponding slots, and wherein the plurality of slots provide adjustment of a position of the shroud to contact the wall to compensate for variation in position of the toilet base with respect to the wall.

13. The method of claim 10, further comprising cutting the shroud at an installation site of the toilet system to match a plumb of a wall in front of which the toilet base is mounted and to match a distance between the wall and the toilet base.

14. The method of claim 13, wherein the front height of the sloped top of the shroud is greater than a height of a top of the rear portion of the toilet sufficient to accommodate a height of the plumbing riser above the rear of the toilet, and wherein the shroud has a front face extending from a top of the rear of the toilet to the front of the sloped top of the shroud.

15. The method of claim 10, further comprising mounting a seat to the toilet bowl in a fixed position such that no gap is formed between a bottom surface of the seat and a top surface of the toilet bowl, wherein the seat has a chamfered outer edge to prevent attachment of a ligature around the toilet seat.

* * * * *